US008727714B2

(12) United States Patent
Snider et al.

(10) Patent No.: US 8,727,714 B2
(45) Date of Patent: May 20, 2014

(54) METHOD OF FORMING A MULTI-PANEL OUTER WALL OF A COMPONENT FOR USE IN A GAS TURBINE ENGINE

(75) Inventors: Raymond G. Snider, Orlando, FL (US); Jay A. Morrison, Cocoa, FL (US)

(73) Assignee: Siemens Energy, Inc., Orlando, FL (US)

( * ) Notice: Subject to any disclaimer, the term of this patent is extended or adjusted under 35 U.S.C. 154(b) by 507 days.

(21) Appl. No.: 13/094,948

(22) Filed: Apr. 27, 2011

(65) Prior Publication Data

US 2012/0275900 A1 Nov. 1, 2012

(51) Int. Cl.
*F01D 25/26* (2006.01)

(52) U.S. Cl.
USPC ..... 415/178

(58) Field of Classification Search
USPC ..... 29/889.22, 890.046, 455.1; 60/752, 60/754–757, 760, 39.37; 415/178, 214.1, 415/215.1
See application file for complete search history.

(56) References Cited

U.S. PATENT DOCUMENTS

| | | | | |
|---|---|---|---|---|
| 4,236,378 | A * | 12/1980 | Vogt | 60/757 |
| 4,498,288 | A * | 2/1985 | Vogt | 60/776 |
| 4,527,397 | A * | 7/1985 | Tobery et al. | 60/757 |
| 5,596,870 | A * | 1/1997 | Dillard et al. | 60/782 |
| 5,782,294 | A | 7/1998 | Froemming et al. | |
| 6,341,485 | B1 | 1/2002 | Liebe | |
| 7,219,498 | B2 | 5/2007 | Hadder | |
| 7,310,938 | B2 | 12/2007 | Marcum et al. | |
| 7,493,767 | B2 | 2/2009 | Bunker et al. | |
| 7,581,385 | B2 * | 9/2009 | Farah et al. | 60/266 |
| 7,614,235 | B2 | 11/2009 | Burd et al. | |
| 2002/0157251 | A1 * | 10/2002 | Esser et al. | 29/889.72 |
| 2003/0106317 | A1 | 6/2003 | Jorgensen et al. | |
| 2003/0106318 | A1 | 6/2003 | Leahy, Jr. | |
| 2008/0155988 | A1 * | 7/2008 | Commaret et al. | 60/755 |
| 2009/0142184 | A1 | 6/2009 | Roberge | |
| 2009/0145099 | A1 | 6/2009 | Jennings et al. | |
| 2010/0018211 | A1 | 1/2010 | Venkataraman et al. | |
| 2010/0034643 | A1 | 2/2010 | Davis, Jr. et al. | |
| 2010/0037618 | A1 | 2/2010 | Charron et al. | |
| 2010/0050649 | A1 | 3/2010 | Allen | |
| 2010/0054928 | A1 | 3/2010 | Schiavo | |
| 2010/0071382 | A1 * | 3/2010 | Liang | 60/806 |
| 2010/0170259 | A1 * | 7/2010 | Huffman | 60/755 |
| 2010/0189933 | A1 * | 7/2010 | Strother | 428/34.1 |
| 2010/0316492 | A1 | 12/2010 | Charron et al. | |

FOREIGN PATENT DOCUMENTS

| | | | |
|---|---|---|---|
| EP | 0624757 | A1 | 11/1994 |
| JP | 58182034 | A | 10/1983 |

OTHER PUBLICATIONS

Ishibashi, Gas Turbine Combustor Tail Cylinder, Oct. 24, 1983, translation of JP58-182034.*

* cited by examiner

*Primary Examiner* — Edward Landrum
*Assistant Examiner* — Liam McDowell

(57) ABSTRACT

A method of forming and/or assembling a multi-panel outer wall (14) for a component (12) in a machine subjected to high thermal stresses comprising providing such a component (12) that includes an inner panel wall (16) having an outer surface, and an array of interconnecting ribs (38) on the outer surface of the component (12). An intermediate panel (22) is provided and preferably preformed to a general outer contour of the component (12), and is positioned over the inner panel (16). An external pressure force is applied across a surface area of the intermediate panel (22) against the outer surface of the component (12) to contour the intermediate panel (22) according to a geometric configuration formed by the ribs (38) thereby forming cooling chambers (24) between the outer surface and ribs (38) of the component (12) and the intermediate panel (22).

21 Claims, 11 Drawing Sheets

METHOD OF FORMING A MULTI-PANEL OUTER WALL OF A COMPONENT FOR USE IN A GAS TURBINE ENGINE

FIELD OF THE INVENTION

This invention is directed generally to gas turbine engines and, more particularly, to components useful for routing gas flow from combustors to the turbine section of a gas turbine engine. More specifically, the invention relates to methods of forming and assembling multi-panel walls having complex geometric contoured outer surfaces.

BACKGROUND OF THE INVENTION

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades and turbine vanes must be made of materials capable of withstanding such high temperatures. Turbine blades, vanes, transitions and other components often contain cooling systems for prolonging the life of these items and reducing the likelihood of failure as a result of excessive temperatures.

This invention is directed to a cooling system for a transition duct for routing a gas flow from a combustor to the first stage of a turbine section in a combustion turbine engine. In one embodiment, the transition duct may have a multi-panel outer wall formed from an inner panel having an inner surface that defines at least a portion of a hot gas path plenum and an intermediate panel positioned radially outward from the inner panel such that one or more cooling chambers is formed between the inner and intermediate panels. In another embodiment, the transition duct may include an inner panel, an intermediate panel and an outer panel. The inner, intermediary and outer panels may include one or more metering holes for passing cooling fluids between cooling chambers for cooling the panels. The intermediary and outer panels may be secured with an attachment system coupling the panels to the inner panel such that the intermediary and outer panels may move in-plane.

The cooling system may be configured to be usable with any turbine component in contact with the hot gas path of a turbine engine, such as a component defining the hot gas path of a turbine engine. One such component is a transition duct. The transition duct may be configured to route gas flow in a combustion turbine subsystem that includes a first stage blade array having a plurality of blades extending in a radial direction from a rotor assembly for rotation in a circumferential direction, said circumferential direction having a tangential direction component, an axis of the rotor assembly defining a longitudinal direction, and at least one combustor located longitudinally upstream of the first stage blade array and may be located radially outboard of the first stage blade array. The transition duct may include a transition duct body having an internal passage extending between an inlet and an outlet. The transition duct may be formed from a duct body that is formed at least in part from a multi-panel outer wall. The multi-panel outer wall may be formed from an inner panel having an inner surface that defines at least a portion of a hot gas path plenum and an intermediate panel positioned radially outward from the inner panel such that at least one cooling chamber is formed between the inner and intermediate panels. The multi-panel outer wall may also include an outer panel positioned radially outward from the intermediate panel such that at least one cooling chamber is formed between the intermediate and outer panels.

The cooling system may include one or more metering holes to control the flow of cooling fluids into the cooling chambers. In particular, the outer panel may include a plurality of metering holes. The intermediate panel may include one or more impingement holes, and the inner panel may include one or more film cooling holes.

The invention is also directed to a method of forming a multi-panel outer wall including an impingement cooling panel for components that are used under high thermally stressed conditions and having complex outer surface contours. The method comprises providing a component to be incorporated in a machine and perform in an environment of high thermally stressed conditions and having an inner panel having an outer surface with an array of interconnected ribs disposed on the outer surface. An intermediate panel is positioned over the component to cover at least a portion of the outer surface and ribs of the component.

The method also includes applying an external force under pressure across a surface area of the intermediate panel against the outer surface of the component to contour the intermediate panel according to a geometric configuration formed by the ribs. In performing this step the cooling chambers are formed between the outer surface and ribs of the component and the intermediate panel. In addition, the method may also comprise forming one or more holes in the intermediate panel and inner panel to allow airflow into and out of the cooling chambers.

The intermediate panel may then be affixed to the inner panel by known techniques. More specifically, the intermediate panels are affixed to the inner panel at first sections of the intermediate panel that contact the ribs on the inner panel.

The cooling system formed from a three-layered system is particularly beneficial for a transvane concept, where the hot gas flow is accelerated to a high Mach number, and the pressure drop across the wall is much higher than in traditional transition ducts. This high pressure drop is not ideal for film cooling, and an impingement panel alone is insufficient to reduce the post-impingement air pressure for ideal film cooling effectiveness. Therefore, the outer panel, which serves primarily as a pressure drop/flow metering device, is especially needed for this type of component.

Upstream portions of the transvane, where the hot gas path velocity is lower and the pressure difference across the wall is also lower, may benefit from the two wall construction, which is the embodiment with the outer wall including the metering holes or wherein the intermediate panel with the impingement holes are sufficient to drop the pressure for film effectiveness.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 10:
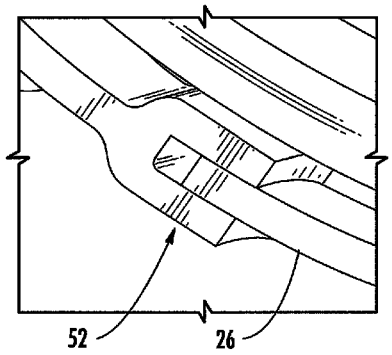
FIG. 10 is another aspect of the attachment system.
Figure 11:
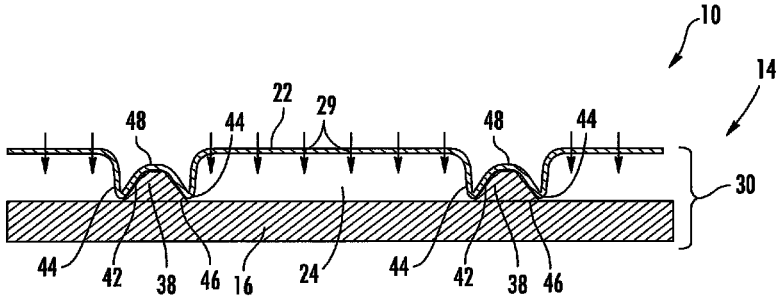
FIG. 11 is a partial cross-sectional view of an alternative embodiment of the multi-panel wall.

As shown in FIGS. 1-16, this invention is directed to a cooling system 10 for a transition duct 12 for routing a gas flow from a combustor (not shown) to the first stage of a turbine section in a combustion turbine engine. The transition duct 12 may have a multi-panel outer wall 14 formed from an inner panel 16 having an inner surface 18 that defines at least a portion of a hot gas path plenum 20 and an intermediate panel 22 positioned radially outward from the inner panel 16 such that one or more cooling chambers 24 is formed between the inner and intermediate panels 16, 22, as shown in FIG. 11. In another embodiment, the transition duct 12 may include an inner panel, an intermediate panel 22 and an outer panel 26. The outer panel 26 may include one or more metering holes 28 for passing cooling fluids into the cooling chambers 24, and the intermediate panel 22 may include one or more impingement holes 29. The inner panel 16 may include one or more film cooling holes 31 for cooling the inner panel 16. The intermediary and outer panels 22, 26 may be secured with an attachment system coupling the panels 22, 26 to the inner panel 16 such that the intermediary and outer panels 22, 26 may move in-plane.

The cooling system 10 may be configured to be usable with any turbine component in contact with the hot gas path of a turbine engine, such as a component defining the hot gas path of a turbine engine. One such component is a transition duct 12, as shown in FIGS. 1-4. The transition duct 12 may be configured to route gas flow in a combustion turbine subsystem that includes a first stage blade array having a plurality of blades extending in a radial direction from a rotor assembly for rotation in a circumferential direction. At least one combustor may be located longitudinally upstream of the first stage blade array and located radially outboard of the first stage blade array. The transition duct 12 may extend between the combustor and rotor assembly.

The transition duct 12 may be formed from a transition duct body 30 having a hot gas path plenum 20 extending between an inlet 34 and an outlet 36. The duct body 30 may be formed from any appropriate material, such as, but not limited to, metals and ceramics. The duct body 30 may be formed at least in part from a multi-panel outer wall 14. The multi-panel outer wall 14 may be formed from an inner panel 16 having an inner surface 18 that defines at least a portion of a hot gas path plenum 20 and an intermediate panel 22 positioned radially outward from the inner panel 16 such that one or more cooling chambers 24 is formed between the inner and intermediate panels 16, 22.

Figure 1:
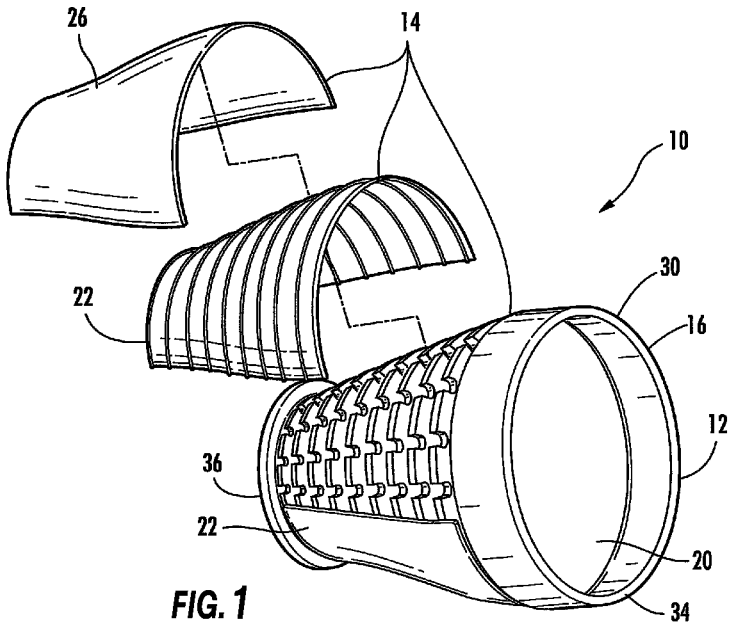
FIG. 1 is an exploded perspective view of a turbine engine component, such as a transition duct, having aspects of the invention.
Figure 2:
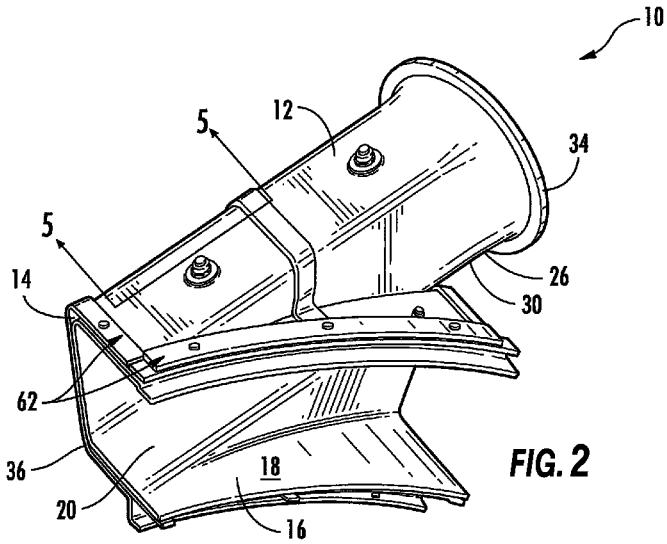
FIG. 2 is a perspective view of an alternative embodiment of a turbine engine component.
Figure 3:
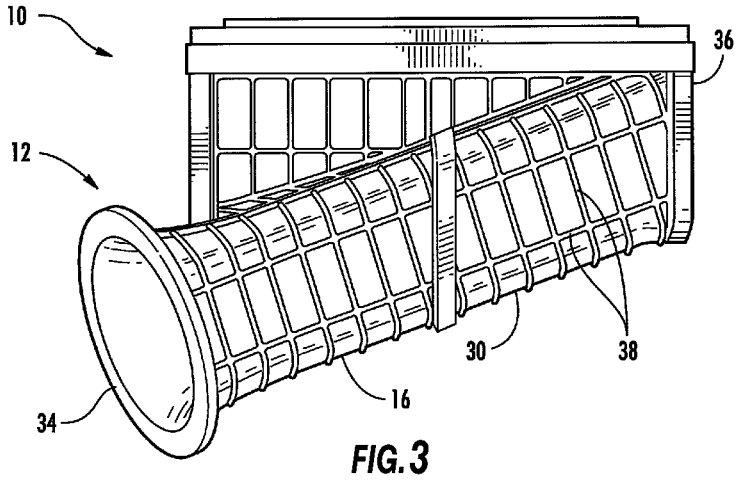
FIG. 3 is a top view of the transition shown in FIG. 2 with only the inner panel shown.
Figure 4:
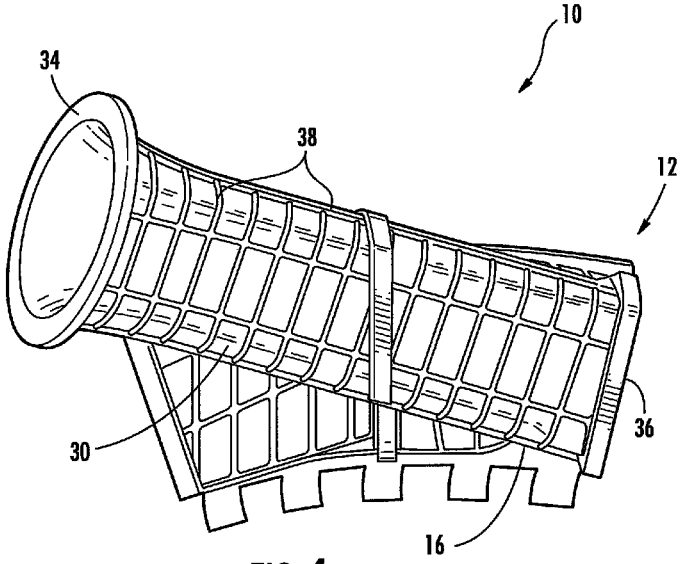
FIG. 4 is an axial view of the transition shown in FIG. 2 with only the inner panel shown.

In at least one embodiment, the inner panel 16 may be formed as a structural support to support itself and the intermediate and outer panels 22, 26. The inner panel 16 may have any appropriate configuration. The inner panel 16 may have a generally conical, cylindrical shape, as shown in FIG. 1, may be an elongated tube with a substantially rectangular cross-sectional area referred to as a transvane in which a transition section and a first row of vanes are coupled together, as shown in FIGS. 2-4, or another appropriate configuration. The outer panel 26 may be formed as a partial cylindrical structure such that two or more outer panels 26 are needed to form a cylindrical structure. Similarly, the intermediate panel 22 may be formed as a partial cylindrical structure such that two or more outer panels 26 are needed to form a cylindrical structure. The cylindrical outer and intermediate panels 26, 22 may be configured to mesh with the inner panel 16 and may be generally conical. The outer panel 26 may be configured to withstand a high pressure differential load. In particular, the outer panel 26 may be stiff relative to the intermediate and inner panels 22, 16, thereby transmitting most of the pressure loads off of the hot structure and onto attachment points.

In another embodiment, as shown in FIG. 11, the cooling system 10 may be formed from inner panel 16 and intermediate panel 22 without an outer panel 26. The impingement holes 29 in the intermediate panel 22 may be sufficient to function without an outer panel 26 with metering holes 28.

Figure 15:
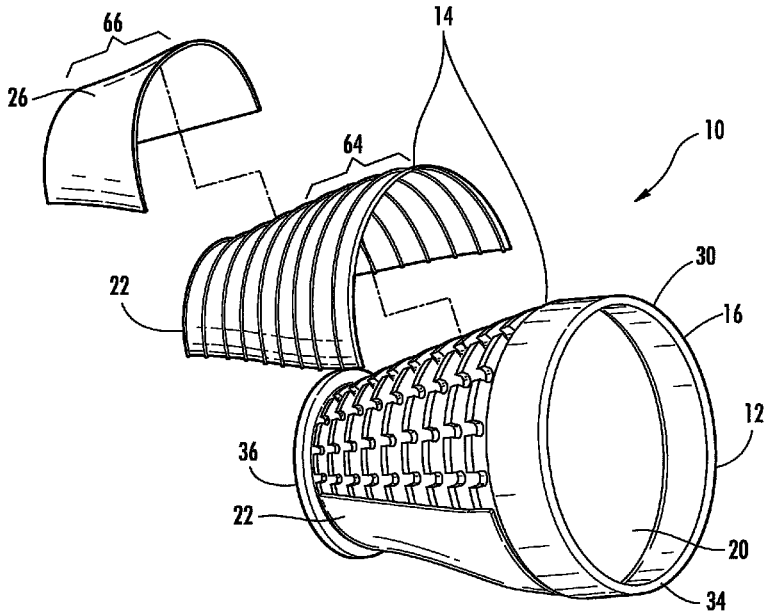
FIG. 15 is a partial cross-sectional side view of an alternative transition duct.

In another embodiment, as shown in FIG. 15, the turbine component may be formed from two sections that are differently configured. In an embodiment in which the turbine component is a transition duct 12, an upper section 64 may be formed from a two-layer system and a lower section 66, which is downstream from the upper section 64, may be formed from a three-layer system. In particular, the upper section 64 may be formed from an inner panel 16 and an intermediate panel 22 without an outer panel 26. The lower section 66 may be formed from an inner panel 16, an intermediate panel 22 and an outer panel 26. The lower section 66 may be included in a location of high velocity. The relative size of the lower and upper sections 66, 64 may change depending on the particular engine into which the transition duct 12 is installed.

Figure 5:
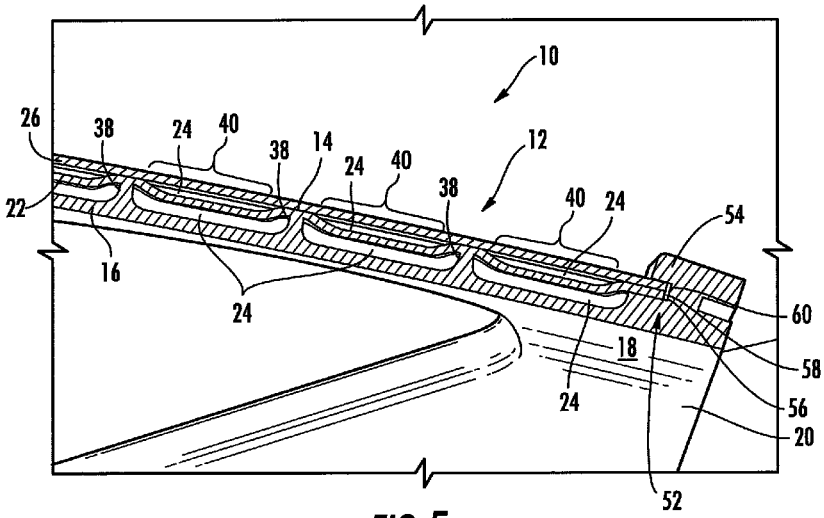
FIG. 5 is a perspective cross-sectional view of a multi-panel outer wall taken at section line 5-5 in FIG. 2.
Figure 6:
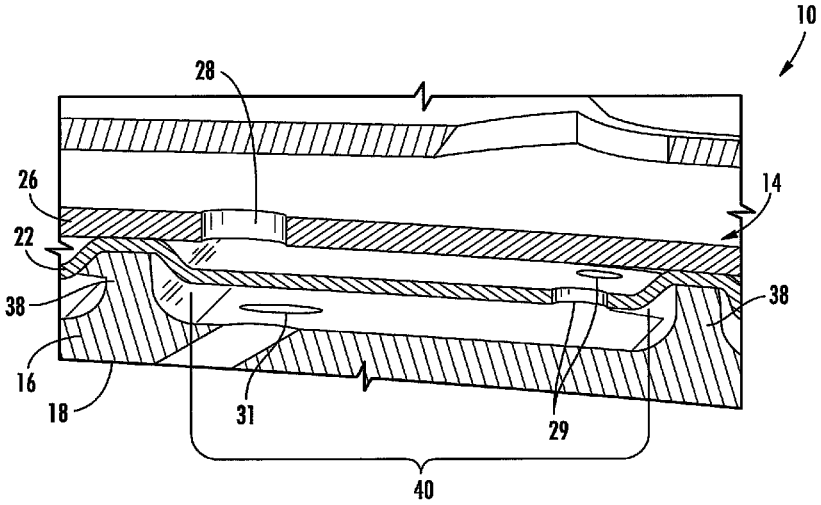
FIG. 6 is a detailed cross-sectional view taken at detail line 6-6 in FIG. 5.
Figure 12:
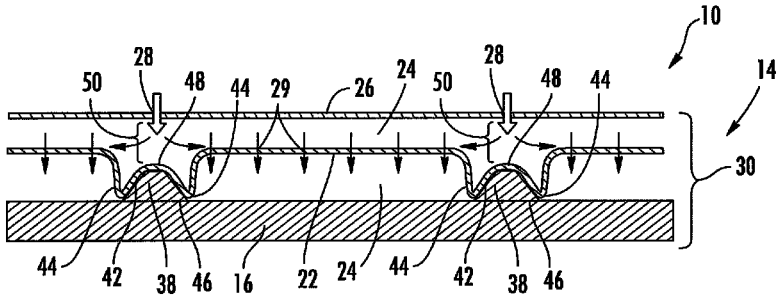
FIG. 12 is a partial cross-sectional view of another alternative embodiment of the multi-panel wall.
Figure 13:
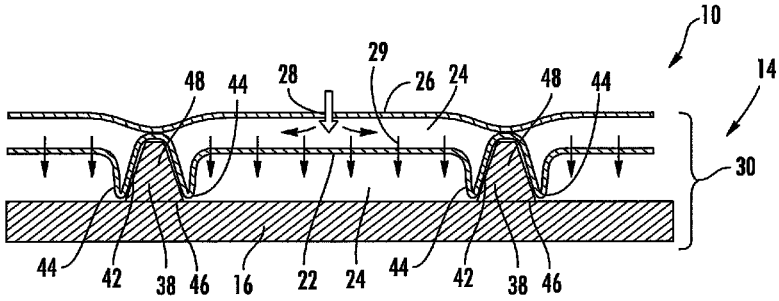
FIG. 13 is a partial cross-sectional view of yet another alternative embodiment of the multi-panel wall.

The multi-panel outer wall 14 may be configured such that cooling chambers 24 are formed between the inner and intermediate panels 16, 22 and between the intermediate and outer panels 22, 26. The cooling system 10 may include one or more ribs 38 extending from the inner panel 16 radially outward into contact the intermediate panel 22. The rib 38 may have any appropriate configuration. The rib 38 may have a generally rectangular cross-section, as shown in FIGS. 5 and 6, may have a generally tapered cross-section, as shown in FIGS. 11-13, or any other appropriate configuration. The tapered cross-section may be configured such that a cross-sectional area of the rib 38 at the base 46 is larger than a cross-sectional area of the rib 38 at an outer tip 48. The benefits of a tapered rib 38 include improved casting properties, such as, but not limited to, mold filling and solidification, removal of shell, etc., and better fin efficiency which reduces thermal stresses. Tapering the ribs 38 makes for a more uniform temperature distribution and less thermal stress between the cold ribs and the hot pocket surface.

Figure 16:
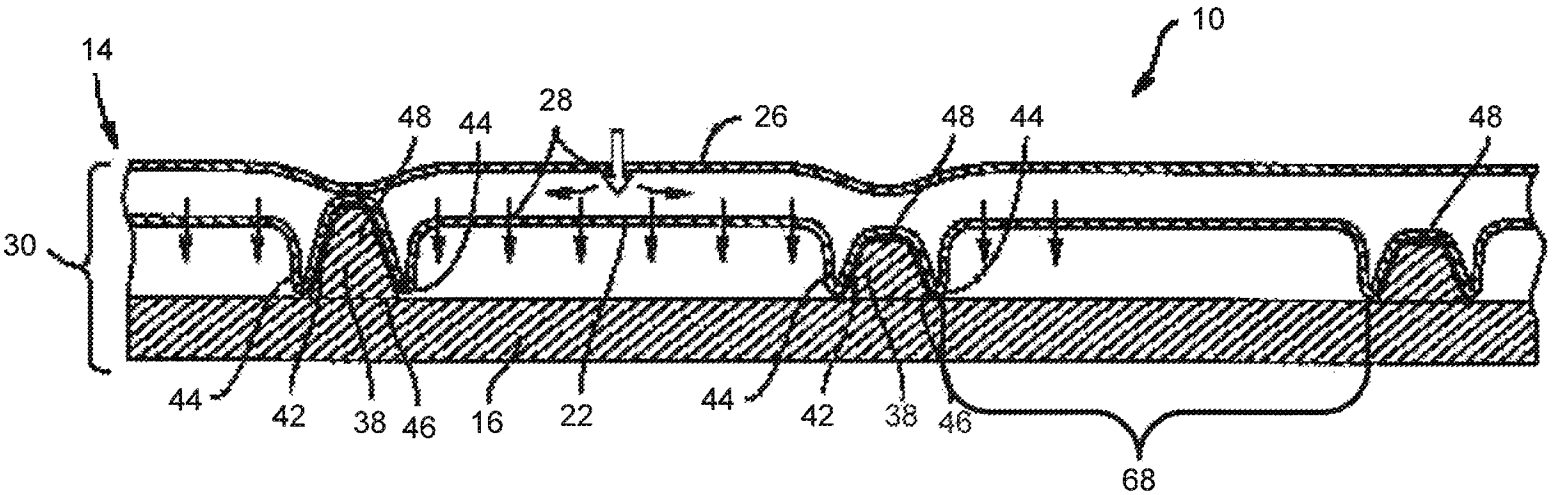
FIG. 16 is a partial cross-sectional view of another alternative embodiment of the multi-panel wall.
Figure 17:
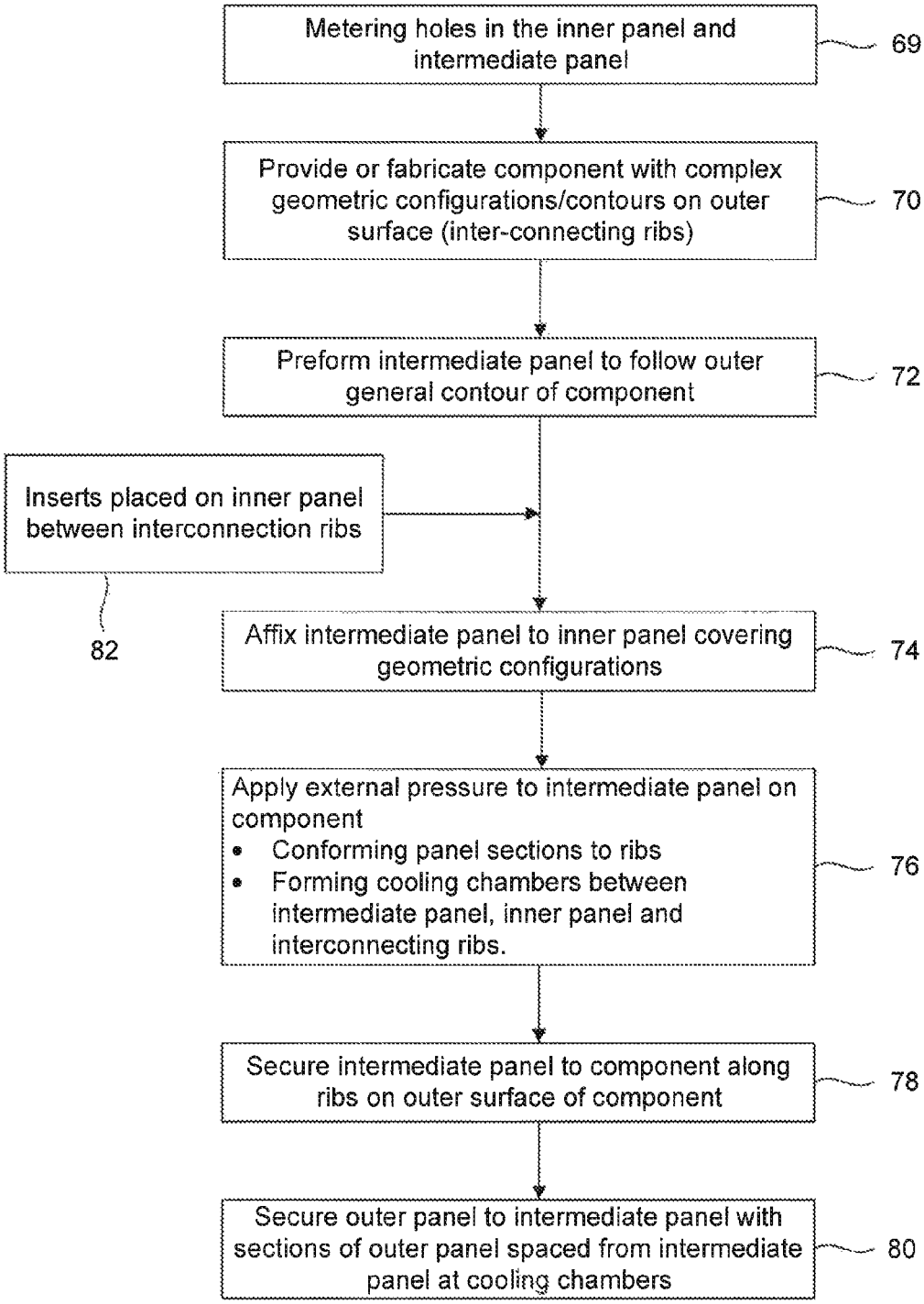
FIG. 17 is a flow diagram illustrating steps for the method of forming and/or assembling the multi-panel outer wall.

As shown in FIG. 16, the ribs 38 may have differing heights from the inner panel 16. As such, the configuration of the intermediate panel 22 may differ to optimize the impingement cooling. In particular, the intermediate panel 22 may include a depression 40 for situations where the intermediate panel 22 needs to be closer to the inner panel 16 for optimal impingement because the height of the ribs 38 is larger than the optimal height. In another situation, the intermediate panel 22 may include a raised section 68 for situations where the intermediate panel 22 needs to be further from the inner panel 16 for optimal impingement because the height of the ribs 38 is less than the optimal height. In another embodiment, the intermediate panel 22 may include neither a depression 40 nor a raised section 68 such as in the case where the rib 38 height and the optimal impingement distance are equal.

Figure 14:
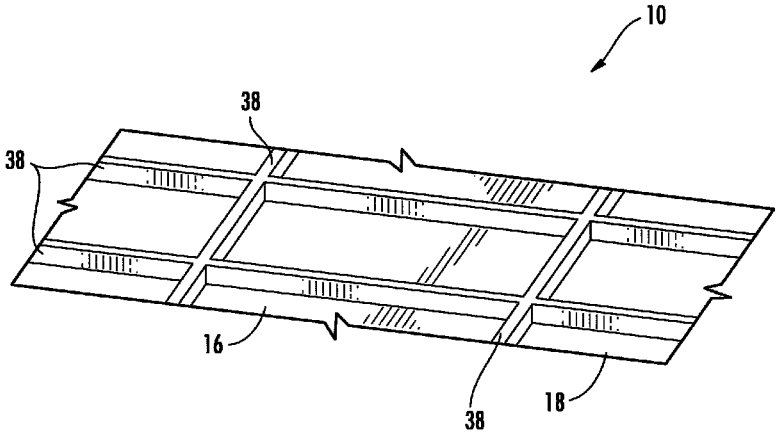
FIG. 14 is a partial perspective view of the outer side of the inner panel.

As shown in FIGS. 3, 4 and 14, the cooling system 10 may include a plurality of interconnected ribs 38. The ribs 38 may be aligned with each other. Some of the ribs 38 may be aligned in a first direction and some of the ribs 38 may be aligned in a second direction that is generally orthogonal to the first direction. In another embodiment, an isogrid type structure (triangular pockets) or hexagonal (honeycomb shape) shaped structure may also be used. The rib 38 spacing, height, width, and shape may vary from one part of the component to another.

As shown in FIGS. 5, 6 and 11-13, the intermediate panel may include one or more depressions 40 positioned between adjacent ribs 38 such that a volume of the cooling chamber 24 between the inner and intermediate panels 16, 22 is reduced when compared with a linear intermediate panel 22. The intermediate panel 22 may be supported by the ribs 38 and may contact the ribs 38. A portion of the intermediate panel 22 may straddle a rib 38 such that a support pocket 42 is formed in the intermediate panel 22. The support pocket 42 may be formed by a support side protrusion 44 formed on each side of the rib 38. Each support side protrusion 44 forming the support pocket 42 may extend radially inward toward the inner panel 16 further than other portions of the intermediate panel 22. The support pockets 42 may be shallow, as shown in FIGS. 5 and 6 or may be deep, as shown in FIGS. 11-13. As shown in FIGS. 11-13, the side support protrusions 44 forming the support pocket 42 may terminate in close proximity to the inner panel 16.

FIGS. 11-13 show not only an intermediate panel 22 with impingement holes 29 with a different height than the ribs 38, but also a method of protecting the ribs from excessive cooling. The ribs 38 may be colder than the hot pocket because the ribs 38 are surrounded by the coolant. This creates undesirably high thermal stresses. The intermediate impingement panel 22 is formed around the rib to shield them from direct impingement or circulation on the ribs 38, thereby making a more uniform temperature distribution in the transition duct.

In at least one embodiment, as shown in FIGS. 5, 6 and 13, the outer panel 26 may contact the intermediate panel 22 at a location radially aligned with a point at which the intermediate panel 22 contacts the rib 38. In one embodiment shown in FIG. 12, a gap 50 may exist between the intermediate panel 22 and the outer panel 26 at a location radially aligned with a point at which the intermediate panel 22 contacts the rib 38. As shown in FIG. 12, the gap 50 enables the formation of a large cooling chamber 24 that spans multiple ribs 38. As shown in FIG. 13, the cooling chambers 24 may be confined to the regions between adjacent ribs 38. The outer and intermediate panels 26, 22 shown in FIG. 13 may be bonded or otherwise attached together as one structure so that vibration and other dynamic loads do not cause excessive wear between the three members 16, 22 and 26.

Figure 7:
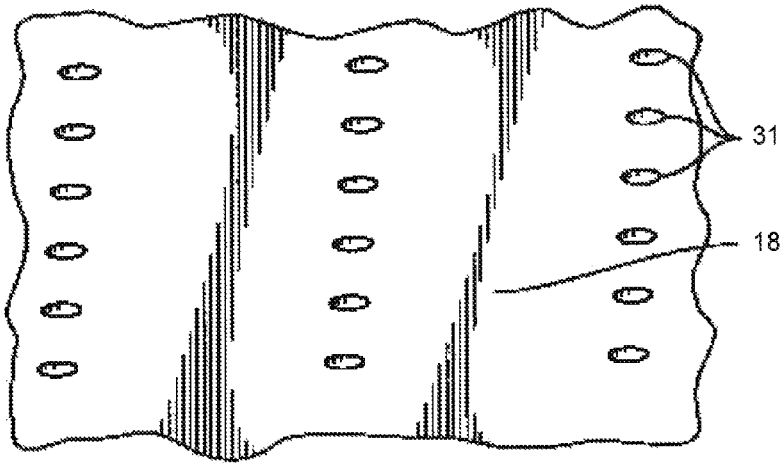
FIG. 7 is a partial detailed view of an inner surface of the inner panel.

As shown in FIG. 6, the multi-panel outer wall 14 may include one or more metering holes 28 for regulating the flow of cooling fluids through the outer wall 14 to cool the components forming the outer wall 14. In particular, the outer panel 26 may include one or more metering holes 28. The intermediate panel 22 may include one or more impingement holes 29, and the inner panel 16 may include one or more film cooling holes 31. The metering holes 28, impingement holes 29 and the film cooling holes 31 may have any appropriate size, configuration and layout. The metering holes 28 may be offset laterally from the impingement holes 29, and the film cooling holes 31 may be offset laterally from the impingement holes 29. As shown in FIG. 7, one or more of the film cooling holes 31 in the inner panel 16 may be positioned nonorthogonally relative to the inner surface 18 of the inner panel 16.

Figure 8:
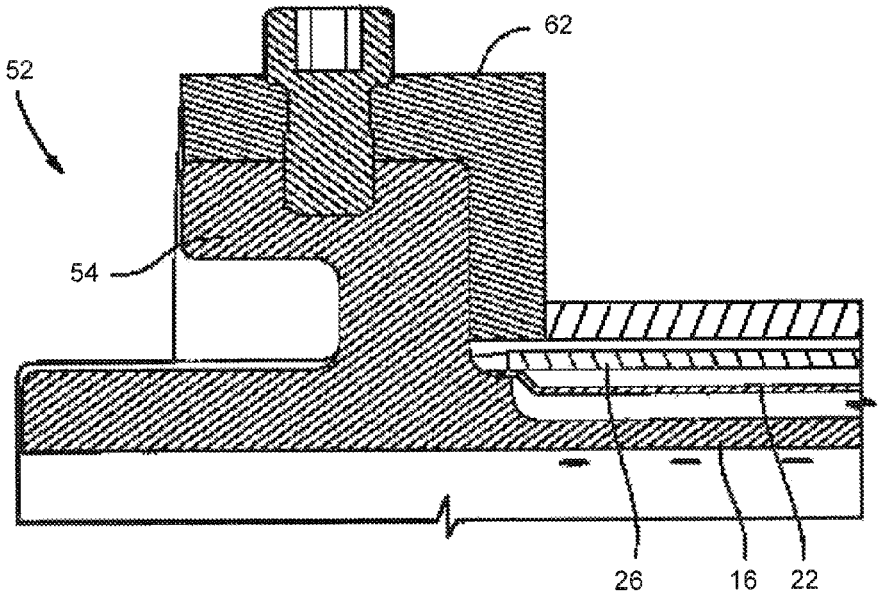
FIG. 8 is an attachment system for coupling the inner, intermediate and outer panels together.
Figure 9:
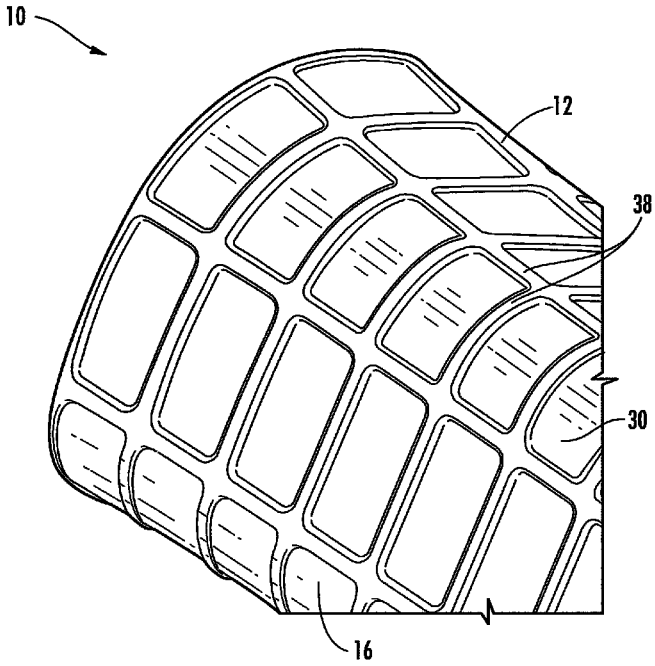
FIG. 9 is a partial perspective view of the inner panel.

An attachment system 52 may be used to construct the multi-panel outer wall 14. In particular, the attachment system 52 may include one or more seal bodies 54 integrally formed with the inner panel 16, as shown in FIGS. 5, 8 and 10. The seal body 54 may include at least one portion extending radially outward with one or more pockets 56 configured to receive a side edge 58 of the intermediate panel 22 in a sliding arrangement such that the intermediate panel 22 is able to move in-plane relative to the attachment system 52. The pocket 56 may also be configured to receive a side edge 60 of the outer panel 26 in a sliding arrangement such that the outer panel 26 is able to move in-plane relative to the attachment system 52. A sealing bracket 62, as shown in FIG. 8, may be releasably coupled to the seal body 54 such that the seal bracket 62 imposes a compressive force directed radially inward on the inner and intermediate panels 16, 22.

During operation, hot combustor gases flow from a combustor into inlet 34 of the transition duct 12. The gases are directed through the hot gas path plenum 20. Cooling fluids, such as, but not limited to, air may be supplied to the shell and flow through the metering holes 28 in the outer panel 26 into one or more cooling chambers 24 wherein the cooling fluids impinge on the intermediate panel 22. The cooling fluids decrease in pressure and pass through the metering holes 28 in the intermediate panel 22 and impinge on the inner panel 16. The depressions 40 enable the impingement holes 29 to be positioned closer to the inner panel 16 thereby increasing the impingement effect on the inner panel 16. The cooling fluids increasing in temperature and pass through the film holes 31 in the inner panel 16 to form film cooling on the inner surface 18 of the inner panel 16.

In reference to the above-described transition duct, the invention is also directed to a method of forming a multi-panel outer wall, including an impingement cooling panel (such as the intermediate panel 22) for components that are used under high thermally stressed conditions and having complex outer surface contours. In the field of turbine machines, the invention may also be characterized as a method of assembling a component of a turbine machine, wherein the component is subject to high thermal stresses during operation of the turbine machine and comprises a multi-panel arrangement forming an airflow pattern for cooling the panels of the component.

The flow diagram shown in *Figure* 17 provides steps for the inventive method including a first step 70 of providing or fabricating a component having complex geometric configurations or contours on an outer surface thereof. For example, the component may be the transition duct 12 depicted in FIGS. 1, 3 and 4 including the interconnected ribs 38 on an outer surface of inner panel 16. In an embodiment, the component provided may be a component that is to be installed into a machine with the below-described intermediate panel 22, or the component may be a master mandrel used to form the intermediate panel 22 for assembly with other components of like dimensions that are intended for installation in a machine, such as a turbine engine.

In following steps 72 and 74, an intermediate panel 22 is provided and preformed to generally follow the outer contour of the component 12, and is temporarily affixed to the component for the formation of the impingement baffle. The general outer contour of the component, for example, may be the general cross-sectional rectangular shape of the transition duct 12 as compared to the more complex geometric configurations formed by the array of ribs 38. The intermediate panel 22 may be affixed to the component, for example, using tack welds at the ribs 38 of the component 12.

Figure 18:
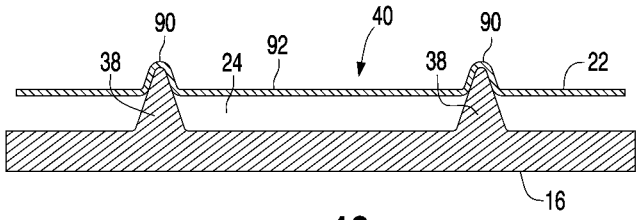
FIG. 18 is a partial sectional view of the multi-panel wall illustrating the formation of the cooling chamber and depression in the intermediate panel.

In following step 76, an external pressure is applied to the intermediate panel 22 on the inner panel wall 16. Known techniques such as hydro-forming in which a liquid-filled bladder and the intermediate panel 22 are compressed together at pressures of about 20,000 psi. In this manner, a uniform pressure may be applied across a surface area of the panel 22 for a sufficient time duration to achieve the desired formation of the intermediate panel 22. As shown in FIG. 18, a sufficient amount of pressure is applied to the intermediate panel 22 for a sufficient time duration so first sections 90 of the intermediate panel 22 conform to a cross-sectional configuration of the ribs 38 (step 76), and depressions 40 are formed in second sections 92 of the intermediate panel between ribs 38. The second sections 92 are spaced apart from the inner panel wall 16 forming the cooling chambers 24. Thus, the amount of external pressure and the time duration of application of the pressure are controlled to control the volume of the cooling chambers 24 between the intermediate panel 22 and outer panel wall 14 (step 76).

At step 78, the intermediate panel 22 is affixed to the inner panel 16 of the component 12 in a more permanent fashion so the component may be prepared for installation of the component 12 into a turbine engine (not shown). The above-described attachment system 52 (FIG. 5) may be used to secure together multiple panels for formation of the cooling chambers 24. In addition or, alternatively, fasteners, crimps, welds, etc., may be incorporated at various locations across the intermediate panel 22, including at the ribs 38, to fasten or affix the intermediate panel 22 to the inner panel 16 of the component 12.

As described above in reference to FIGS. 6 and 7, the multi-panel outer wall 14 preferably includes metering holes 28 in the inner panel 16 and intermediate panel 22 to allow airflow into and out of the cooling chambers 24. Accordingly, step 69 includes forming metering holes in the component outer surface and/or intermediate panel 22 at locations to be associated with cooling chambers 24. Step 69, including the formation of metering holes in the component, is preferably done at some point before or as part of step 70. In addition, step 69, including the formation of metering holes 28 in the intermediate panel 22, may be performed at any stage of the method or process prior to step 78, when the intermediate panel 22 is permanently affixed to the component 12.

Again with respect to FIG. 16, alternative steps 80 and 82 are provided. More specifically, at step 80 an outer panel 26 may be attached to the component 12 and may serve as a pressure metering plate and may or may not contain metering holes 28. In addition, the outer panel 26 does not have to contact the intermediate panel 22 or inner panel 16 except at areas of attachment, for example, along side edges as shown in FIG. 5. Alternatively, the outer panel 26 may be affixed to the intermediate panel 22 at ribs 38 as shown in FIG. 13.

Figure 19:
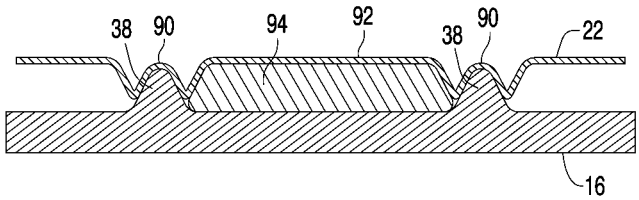
FIG. 19 is a partial sectional view of the multi-panel wall illustrating an embodiment of the method whereby an insert is used to determine the volume of the cooling chamber.

With respect to step 82, inserts 94 (as shown in FIG. 19) may be positioned on the inner panel 16 of the component 12 between ribs 38 before steps 74 and 76 where the intermediate panel 22 is affixed to the inner panel 16 before application of the external pressure. These inserts 94 may be provided in cases where application of an excess external pressure is necessary, such as when the composition of the intermediate panel demands greater force to form the intermediate panel 22 to the ribs 38, or where a prescribed stand-off distance of the second sections 92 of the intermediate panel 22 relative to the inner panel 16 is greater than a height of the ribs 38. In addition, this step 82 may be preferred for instances when conformance of the intermediate panel 22 to the ribs 38 and a desired volume of the cooling chamber 24 are more critical.

The foregoing is provided for purposes of illustrating, explaining, and describing embodiments of this invention. Modifications and adaptations to these embodiments will be apparent to those skilled in the art and may be made without departing from the scope or spirit of this invention.

The invention claimed is:

1. A method of forming a multi-panel outer wall including an impingement cooling panel for components that are used under high thermally stressed conditions and having complex outer surface contours, comprising:

providing a component to be incorporated in a machine and perform in an environment of high thermally stressed conditions and comprising an inner panel having an outer surface with an array of interconnecting ribs with a respective base disposed on the outer surface, said interconnecting ribs having a tapered cross-section such that a cross-sectional area at the base of the interconnecting ribs is larger than a cross-sectional area at an outer tip of the interconnecting ribs;

positioning an intermediate panel over the inner panel to cover at least a portion of the outer surface and the interconnecting ribs of the inner panel;

applying an external force under pressure across a surface area of the intermediate panel against the outer surface of the inner panel to contour the intermediate panel according to a geometric configuration formed by the interconnecting ribs, thereby forming cooling chambers between the outer surface and the interconnecting ribs of the inner panel and the intermediate panel; and, forming one or more holes in the intermediate panel and the inner panel to allow air flow into and out of the cooling chambers.

2. The method of claim 1, further comprising forming depressions in the intermediate panel between the interconnecting ribs.

3. The method of claim 1, wherein the applying external force under pressure to the intermediate panel comprises applying the external force at a predetermined pressure for a predetermined time duration.

4. The method of claim 1, further comprising positioning one or more inserts on the outer surface of the inner panel between interconnecting ribs and between the outer surface of the inner panel and the intermediate panel to form the cooling chambers having a volume determined by outer dimensions of the insert.

5. The method of claim 1, further comprising temporarily securing the intermediate panel along the interconnecting ribs of the inner panel before applying the external force under pressure.

6. The method of claim 1, further comprising forming the intermediate panel to coincide to an outer contour of the inner panel before applying the external pressure force.

7. The method of claim 1, wherein the step of providing the inner panel comprises providing a transition duct for a gas turbine engine and the inner panel having an inner surface defining a plenum through which air flows.

8. A method of assembling a component of a turbine machine, wherein the component is subject to high thermal stresses during operation of the turbine machine and comprises a multi-panel arrangement forming an air flow pattern for cooling the panels of the component, the method comprising:

providing a component to be incorporated in a turbine engine and function in an environment of high thermally stressed conditions and having an inner panel with an outer surface and an array of interconnecting ribs with a respective base disposed on the outer surface, said interconnecting ribs having a tapered cross-section such that a cross-sectional area at the base of the interconnecting ribs is larger than a cross-sectional area at an outer tip of the interconnecting ribs;

positioning an intermediate panel on the inner panel covering at least a portion of the outer surface of the inner panel and a portion of the interconnecting ribs on the inner panel;

applying an external pressure force across a surface area of the intermediate panel at a predetermined pressure and for a predetermined time duration whereby first sections of the intermediate panel that contact respective interconnecting ribs on the inner panel conform to an outer geometric configuration of the interconnecting ribs and second sections of the intermediate panel between the first sections and the interconnecting ribs are spaced apart from the outer surface of the inner panel forming cooling chambers between interconnecting ribs, the inner panel and the intermediate panel, said second sections being spaced apart from the outer surface of the inner panel by a distance greater than a height of the interconnecting ribs from the outer surface of the inner panel; and, forming holes in the second sections of the intermediate panel and in the inner panel in fluid communication with the cooling chambers to allow air flow into and out of the cooling chambers.

9. The method of claim 8, further comprising securing the intermediate panel to the inner panel along the first sections of the intermediate panel and the interconnecting ribs.

10. The method of claim 8, further comprising positioning one or more inserts on the outer surface of the inner panel between the interconnecting ribs and between the outer surface of the inner panel and the intermediate panel to form the cooling chambers having a volume determined by outer dimensions of the insert.

11. The method of claim 8, wherein the applying an external pressure force comprises forming a depression on the second sections of the intermediate panel relative to the interconnecting ribs.

12. The method of claim 11, further comprising securing an outer panel to the intermediate panel along the first sections of the intermediate panel and wherein second sections of the outer panel are spaced apart from the second sections of the intermediate panel.

13. The method of claim 8, further comprising pre-forming the intermediate panel to coincide with a general outer contour of the inner panel before applying the external pressure force to the intermediate layer.

14. A component for a turbine machine wherein the component is subject to high thermal stresses during operation of the turbine machine and includes a multi-panel arrangement forming an air-flow pattern for cooling the panels of the component, the component comprising:

an inner panel having an outer surface with an array of interconnecting ribs disposed thereon and extending radially outward from the outer surface;

an intermediate panel secured to the inner panel along the interconnecting ribs whereby an external pressure force having been applied at a predetermined pressure for a predetermined time duration across a surface area of the intermediate panel thereby forming first sections of the intermediate panel that conform to an outer geometric configuration of the interconnecting ribs and forming second sections of the intermediate panel between the first sections and the interconnecting ribs, and the second sections of the intermediate panel are spaced apart from the outer surface of the inner panel forming cooling chambers between the interconnecting ribs, the outer surface of the inner panel and the second sections of intermediate panel, said second sections being spaced apart from the outer surface of the inner panel by a distance greater than a height of the interconnecting ribs from the outer surface of the inner panel; and, one or more holes formed in a plurality of the second sections of the intermediate panel and one or more holes formed in the outer surface of the inner panel between the interconnecting ribs to allow air flow into and out of the cooling chambers.

15. The component of claim 14, wherein the inner panel is a transition duct for a turbine machine that is disposed between a combustor and turbine blade stage of the turbine machine.

16. The component of claim 14, wherein the external pressure force is applied to the intermediate panel at the predetermined pressure and for the predetermined time duration so that the second sections of the intermediate panel are spaced from the outer surface of the inner panel between the interconnecting ribs a distance dimension that is less than a height dimension of the interconnecting ribs.

17. The component of claim 14, wherein the first sections of the intermediate panel thermally isolate the interconnecting ribs from air flowing in or through the cooling chambers.

18. The component of claim 14, wherein, before the external pressure force is applied to the intermediate panel, one or more inserts are removably positioned on the outer surface of the inner panel between interconnecting ribs and between the outer surface of the inner panel and the intermediate panel to form the cooling chambers having a volume determined by outer dimensions of the insert.

19. The component of claim 14, further comprising an outer panel secured to the inner panel and disposed over the intermediate panel and the outer panel includes first sections secured against the first sections of the intermediate panel and wherein second sections of the outer panel are spaced apart from the second sections of the intermediate panel forming an airflow path therebetween.

20. The component of claim 19, wherein a plurality of the second sections on the intermediate panel are depressed relative to the ribs on the inner panel thereby spacing the second sections of the intermediate panel and the outer panel forming the airflow paths therebetween.

21. The component of claim 14, wherein the component includes:

an upper section including a two-layer system of the inner panel and the intermediate panel with the cooling chambers formed between the interconnecting ribs, the outer surface of the inner panel and the second sections of the intermediate panel; and a lower section downstream of the upper section, said lower section including a three-layer system including an outer panel secured to the inner panel and disposed over the intermediate panel; wherein the outer panel includes first sections secured against the first sections of the intermediate panel and wherein second sections of the outer panel are spaced apart from the second sections of the intermediate panel forming secondary cooling chambers between the section sections of the intermediate panel and the section sections of the outer panel.

* * * * *